United States Patent [19]

Johnson, Sr.

[11] 4,361,630

[45] Nov. 30, 1982

[54] ULTRA-BLACK COATING DUE TO SURFACE MORPHOLOGY

[75] Inventor: Christian E. Johnson, Sr., Middletown, Md.

[73] Assignee: The United States of America as represented by the Secretary of the Commerce, Washington, D.C.

[21] Appl. No.: 293,783

[22] Filed: Aug. 18, 1981

Related U.S. Application Data

[60] Continuation of Ser. No. 156,442, Jun. 4, 1980, abandoned, which is a division of Ser. No. 31,706, Apr. 20, 1979, Pat. No. 4,233,107.

[51] Int. Cl.[3] ..... B32B 3/00; B32B 15/04; B32B 15/16

[52] U.S. Cl. ..... 428/613; 428/141; 428/551; 428/552; 428/561; 428/670; 428/680; 428/687; 428/936; 126/901

[58] Field of Search ..... 428/561, 613, 624–626, 428/670, 680, 687, 630, 936, 551–552, 433, 457–463, 469, 471, 472, 141; 146/901

[56] References Cited

U.S. PATENT DOCUMENTS

| | | | |
|---|---|---|---|
| 3,533,863 | 10/1970 | Lee et al. | 156/654 |
| 3,615,948 | 10/1971 | Krostewitz | 156/664 |
| 3,867,207 | 2/1975 | Decker et al. | 427/328 |
| 3,899,400 | 8/1975 | Patrie et al. | 204/129.75 |
| 3,932,694 | 1/1976 | Hamaguchi et al. | 428/432 |
| 3,953,624 | 4/1976 | Arnold | 427/305 |
| 4,008,343 | 2/1977 | Cohen et al. | 427/305 |
| 4,154,705 | 5/1979 | Baldi et al. | 252/466 J |
| 4,160,049 | 7/1979 | Narcus | 427/305 |
| 4,209,008 | 6/1980 | Lemkey et al. | 126/901 |

FOREIGN PATENT DOCUMENTS

| | | | |
|---|---|---|---|
| 54-48344 | 4/1979 | Japan | 126/901 |

OTHER PUBLICATIONS

Pearlstein, F., "Electroless Plating", *Modern Electroplating* John Wiley & Sons, Inc. pp. 710–731 (1974).

Weast, R. C. ed.; *Handbook of Chemistry and Physics* Chemical Rubber Co., Cleveland, Ohio, p. B-199 (1967).

*Primary Examiner*—Michael L. Lewis

*Attorney, Agent, or Firm*—Eugene J. Pawlikowski; Alvin J. Englert

[57] ABSTRACT

The invention provides a method of producing an ultra-black surface coating, having an extremely high light absorption capacity, on a substrate, such as a metal, ceramic, glass, or plastic, the blackness being associated with a unique surface morphology consisting of a dense array of microscopic pores etched into the surface, as well as the resulting coated substrate.

The ultra-black surface, which has a spectral reflectance on the order of about from 0.5 to 1.0% at wavelengths of light of about from 320 to 2140 nanometers, finds use as a solar collector in the field of solar energy.

2 Claims, 5 Drawing Figures

PRIOR ART

ULTRA-BLACK COATING DUE TO SURFACE MORPHOLOGY

This is a continuation of application Ser. No. 156,442, filed June 4, 1980, abandoned, which is a division of application Ser. No. 31,706, filed Apr. 20, 1979, now U.S. Pat. No. 4,233,107, issued Nov. 11, 1980.

This invention relates to the production of black surface coatings.

More particularly, the invention relates to a method of producing an ultra-black surface coating with an extremely high light absorption capacity on a variety of substrates, this ultra-black surface coating being produced by preferential chemical attack on an electroless nickel-phosphorus alloy deposited on the substrate in a bath consisting of aqueous nitric acid solution. The resulting blackness of the surface coating is associated with a unique morphology consisting of a multitude of microscopic conical pores etched perpendicularly into the surface.

The object of the invention is the provision of a method of producing such an ultra-black surface coating on a substrate and also the resulting coated substrate.

Prior art methods for producing a black surface coating involve such procedures as depositing on the substrate a coating of black paint, a coating of black surface oxides or metallic compounds, a black coating of metal alloys, or a black coating of mixed metal and oxides. The present method is distinguished from these prior art methods by the fact that the blackness of the surface coating is due to the above-described morphology rather than to the deposited black coatings of the prior art, the latter being exemplified in U.S. Pat. No. 3,867,207 to Decker et al.

This Decker et al. patent provides a process similar to that of the present invention but differs therefrom in one critical step, namely, in that the Decker et al. process utilizes an etchant bath containing a mixture of phosphoric, sulfuric, and nitric acids whereas the present process utilizes an etchant bath consisting solely of an aqueous solution of nitric acid wherein the nitric acid concentration ranges from a 1:5 ratio with distilled or de-ionized water to concentrated. Further, the Decker et al. process also requires a final heating step in which, after washing and drying the etched product, it is fired for about one hour in air at about 450° C. The fired coating is found to be covered with a black compound, which Decker et al. believe is nickel phosphide. In contrast, the invention omits the firing step, and the etched coating is not a black compound, but consists of the electroless nickel-phosphorus alloy completely etched with microscopic pores.

BRIEF DESCRIPTION OF THE DRAWINGS

To illustrate the difference in products obtained, the accompanying FIGS. 1A and 1B provide scanning electron micrographs of the surface morphology of the blackened electroless nickel-phosphorus alloy coating after chemical attack in 50% $HNO_3$ at 50° C., according to the present invention (and not including the last treating step of Decker et al), the original magnification being 1700X and 2000X, respectively (these micrographs being further described in the illustrative example hereinafter), while accompanying FIGS. 2A and 2B provide scanning electron micrographs of the surface morphology of the coating on electroless nickel obtained in U.S. Pat. No. 3,867,207 issued to Decker et al., the original magnification being 1800X and 1600X, respectively. A comparison of the morphological structures shown in these electron micrographs clearly point up the striking differences therebetween. As shown in FIGS. 1A and 1B, the surface of the inventive coating is completely etched into a dense array of microscopic conical pores that extend perpendicularly into the nickel-phosphorus alloy. The average maximum pore diameter, pore depth, and pore spacing all range from a fraction of a micrometer to several micrometers, or about a fraction to several wavelengths of light. Consequently the pores (which are invisible to the naked eye) trap any incident light, causing the surface to appear intensely black, even though the alloy is intrinsically reflective. The Decker et al. surface, shown in FIGS. 2A and 2B, consists of flat granules of a black compound formed on the surface of the nickel-phosphorus alloy. The blackness is due to the compound and not to the morphology of the surface.

Figure 1A:
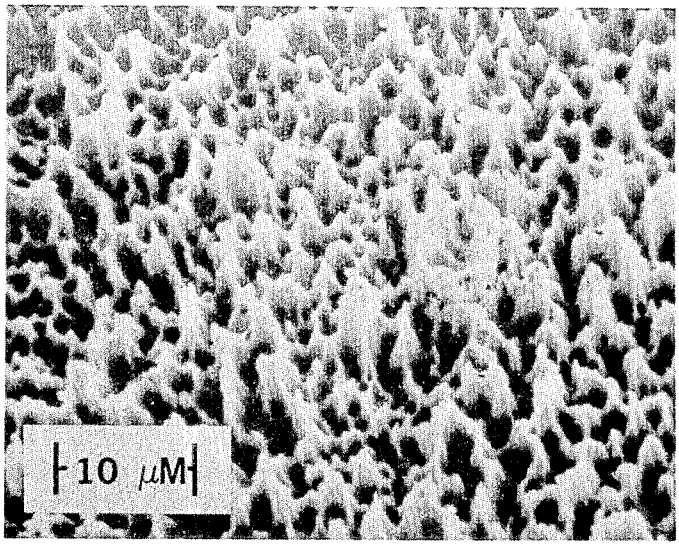
FIGS. 1A, 1B, 2A, 2B are photomicrographs.

In general, the invention provides a method of producing an ultra-black surface coating, having an extremely high light absorption capacity, on a substrate, the blackness being associated with a unique surface morphology consisting of a dense array of microscopic pores etched into the surface, and the resulting coated substrate.

The method comprises preparing the substrate for plating with a nickel-phosphorus alloy, as by cleaning and/or activating it, immersing the thus-prepared substrate in an electroless plating bath containing nickel and hypophosphite ions in solution until an electroless nickel-phosphorus alloy coating (generally containing about from 3.7 to 12.2 mass percent of phosphorus) has been deposited on the substrate, and then removing the resulting substrate, with the electroless nickel-phosphorus alloy coated thereon, from the plating bath, and washing and drying it.

The dried substrate, coated with the electroless nickel-phosphorus alloy, is then immersed in an etchant bath consisting of aqueous nitric acid solution wherein the nitric acid concentration ranges from a 1:5 ratio with distilled or de-ionized water to concentrated, at a temperature of about from 20° C. to 100° C., until the substrate surface develops ultra-blackness, which blackness is associated with the unique morphology described above. The total immersion time may range from about 5 seconds to 5 minutes.

The resulting substrate, covered with the nickel-phosphorus alloy coating having the ultra-black surface and the aforedescribed morphology, is thereafter washed and dried.

The ultra-black surface has a spectral reflectance on the order of about from 0.5 to 1.0% at wavelengths of light of about from 320 to 2140 nanometers (0.32 to 2.13 micrometers), which adapts it for use in solar energy.

Electroless nickel-phosphorus coatings are commonly applied by the electroplating industry. The process depends on the reduction of nickel ions in solution with hypophosphite—an autocatalytic process. Electroless plating differs in one significant respect from all the other aqueous chemical plating procedures in that it is the only chemical plating process which does not depend on the presence of a couple between galvanically dissimilar metals. The coating material, as deposited, is commonly considered to be a supersaturated solution of phosphorus in nickel. The phosphorus content is normally about 8 mass percent, but can be varied between 2 and 13 percent to control strength, ductility, corrosion resistance, and structure. These coatings can be applied to a variety of substrates—metals, ceramics, glass and plastics.

In carrying out the method of the invention, the electroless nickel-phosphorus coating can be applied to a variety of substrates, e.g., metals, ceramics, glass and plastics. Most metals can be plated with electroless nickel-phosphorus alloy after first degreasing the substrate, immersing it in a suitable acid dip to remove surface oxides, and then rinsing it in either de-ionized or distilled water. Metals, such as Pd, Ni, Co, Fe, and Al can be plated directly with electroless nickel-phosphorus alloy by just immersing them in the plating solution. Other metals, such as Cu, Ag, and brass require a catalytic activation before electroless nickel-phosphorus alloy can be applied, with such catalytic activation being achieved by contacting the metal with steel, nickel, or aluminum, by applying momentary cathodic current, and by applying a Pd film. Non-conductors, such as ceramics, glass and plastics have to be activated before electroless nickel-phosphorus alloy can be applied, this activation being accomplished by immersing the non-conductor in a colloidal Pd suspension, immersing the $PdCl_2$ solution, or immersing in $SnCl_2$ and then $PdCl_2$ solutions.

After the substrate has been properly prepared through cleaning and activation, if needed, it is immersed in an electroless plating bath containing nickel and hypophosphite ions in solution for about from 15 minutes to 2 hours. A number of such electroless plating baths are commercially available and excellent results have been obtained with Enplate Ni-415, available from Enthone Incorporated, New Haven, Conn., and with Sel-Rex Lectroless Ni, available from Sel-Rex Corporation, Nutley, N.J. A number of other such electroless plating baths are disclosed in Brenner et al., U.S. Pat. No. 2,532,283. I have employed two "modified Brenner" baths; one is composed of 32 grams per liter of nickel sulfamate, 50 grams per liter sodium hydroxyacetate, 3 grams per liter boric acid, and 10 grams per liter of sodium hypophosphite with the pH of the bath being maintained at about from 3.5 to 6.5 and the bath temperature being about from 90° to 100° C. If necessary, the pH can be adjusted with sodium hydroxide or sulfamic acid. The other "modified Brenner" bath is composed of 30–60 grams per liter of nickel chloride, 50–75 grams per liter of sodium hydroxyacetate and 1–10 grams per liter of sodium hypophosphite with the pH of the plating bath being maintained at about from 3.5 to 6.5, and the bath temperature being about from 50° C. to 100° C. If necessary, the pH can be adjusted with sodium hydroxide or hydrochloric acid.

After immersion of the substrate in the electroless nickel-phosphorus alloy bath for the aforementioned time of about from 15 minutes to 2 hours, the substrate is removed and rinsed in distilled, de-ionized, or tap water, and dried. The substrate with the electroless nickel-phosphorus alloy now deposited thereon and in which the phosphorus content ranges from about 3.7 to 12.2 mass percent, is then immersed in a bath consisting of an aqueous solution of nitric acid. The nitric acid concentration can range from a 1:5 ratio with distilled or de-ionized water to concentrated. The temperature of the nitric acid solution can range from about 20° C. to 100° C. The total time of immersion may range from about 5 seconds to 5 minutes. The time for the blackness to develop on the electroless nickel-phosphorus alloy is dependent on the concentration of the nitric acid solution, the phosphorus content of the alloy, and the solution temperature. Normally, the blackness develops in about from 5 to 15 seconds in a 1 part water—1 part concentrated nitric acid solution at 50° C. After the electroless nickel-phosphorus alloy coated substrate has been etched, it is quickly rinsed in tap water, distilled or de-ionized water, and/or ethyl alcohol, and dried.

Scanning electron micrographs reveal different etched surface morphologies with varying phosphorus content (3.7 to 12.2 mass percent) in the electroless nickel-phosphorus alloy when etched in 1:1 nitric acid at 50° C. for 15–20 seconds. Electroless nickel deposits with phosphorus contents of 12 mass percent required 1 minute or more of etching for the blackness to develop. The degree of blackness obtained is dependent on the immersion time, etchant temperature, and the composition of the alloy. An 8% alloy became ultra-black in about 15–20 seconds.

Specimens of the blackened electroless nickel-phosphorus alloy as a free film or on copper and steel substrates produced by use of the "modified Brenner" baths have been measured for spectral reflectance on three different spectrophotometers, namely, Cary 14, Cary 17D, and an Edwards-type using an integrating sphere. All of the measurements have shown the spectral reflectance to be on the order of about from 0.5–1.0% at wavelengths of light ranging from about 320 to 2140 nanometers. Emissivity was measured at approximately 50% at room temperature for one of the blackened specimens. Qualitative wear resistance was performed by abrading the blackened surface with a pencil eraser which appeared to remove the black surface but in reality was only breaking off the sharp peaks of the etched surface thus leaving more land area for light reflection. The pores were still present in the coating as revealed by scanning electron micrographs of the abraded area. Additional work will be required to reduce the presently obtained emissivity level and to improve the wear resistance. Corrosion resistance and thermal stability have yet to be determined.

The low spectral reflectance of this coating puts it at or near the top of absorption capability for any known coating. This capability of the ultra-black surface of this coating may offer potential for applications to flat plate solar collectors and for use in low temperature calorimetry studies. Other interests have been generated for the possible use of this unique surface morphology on radiometers and because of the large surface area, as a catalyst.

The following example is illustrative of the invention.

Figure 1B:
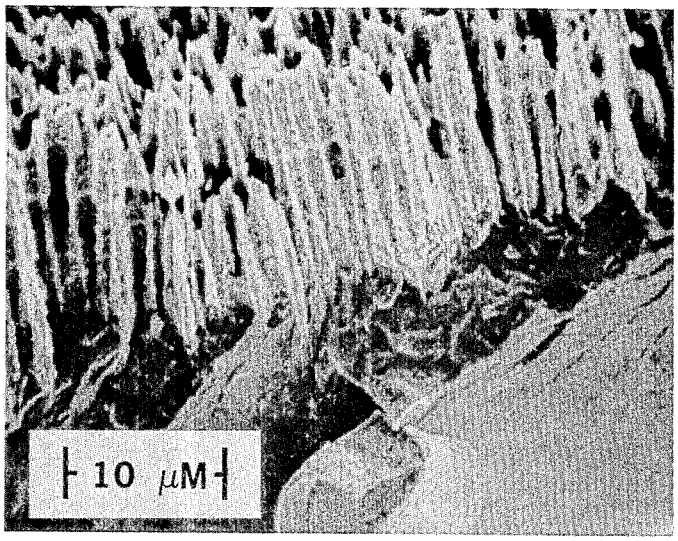
Figure 2A:
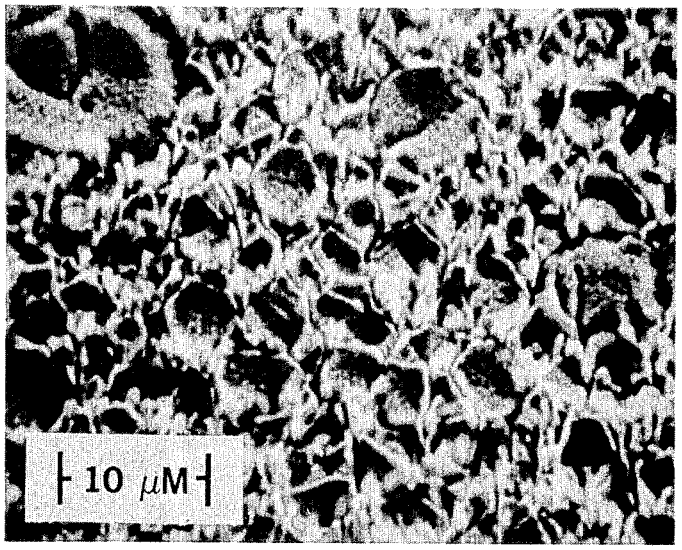
Figure 2B:
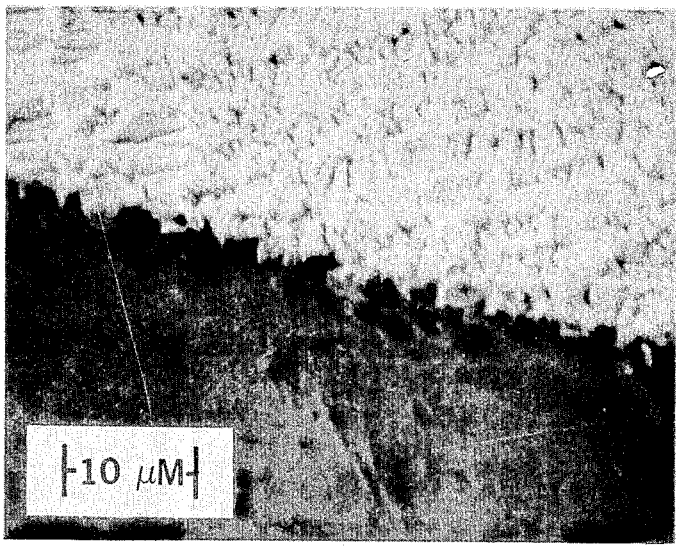

An electroless nickel-phosphorus coating was applied to copper or steel substrate from the first "modified Brenner" bath. The unique surface morphology was developed by immersing the electroless nickel-phosphorus deposits, of appropriate composition, in 1:1 $HNO_3$ solution at 50° C. until the blackness appears. The degree of blackness obtained is dependent on the immersion time and the composition of the alloy. An 8% alloy became ultra-black in about 15–20 seconds. The acid selectively dissolves the coating leaving a microscopically thin honeycomb structure with pores extending into, and in some cases through, the coating. This structure is evident in the scanning electron micrographs seen in the aforesaid accompanying FIGS. 1A and 1B in which FIG. 1A is a scanning electron micrograph of the chemically etched surface of the electroless nickel-phosphorus deposit, the micrograph having been shot at an angle of 39° from normal to the surface, and in which FIG. 1B is a scanning electron micrograph of the cross-section of the chemically etched surface of the electroless nickel-phosphorus deposit and the remaining bulk of the unetched deposit, the micrograph having been shot at an angle of 68° from normal to the surface.

Figure 3:
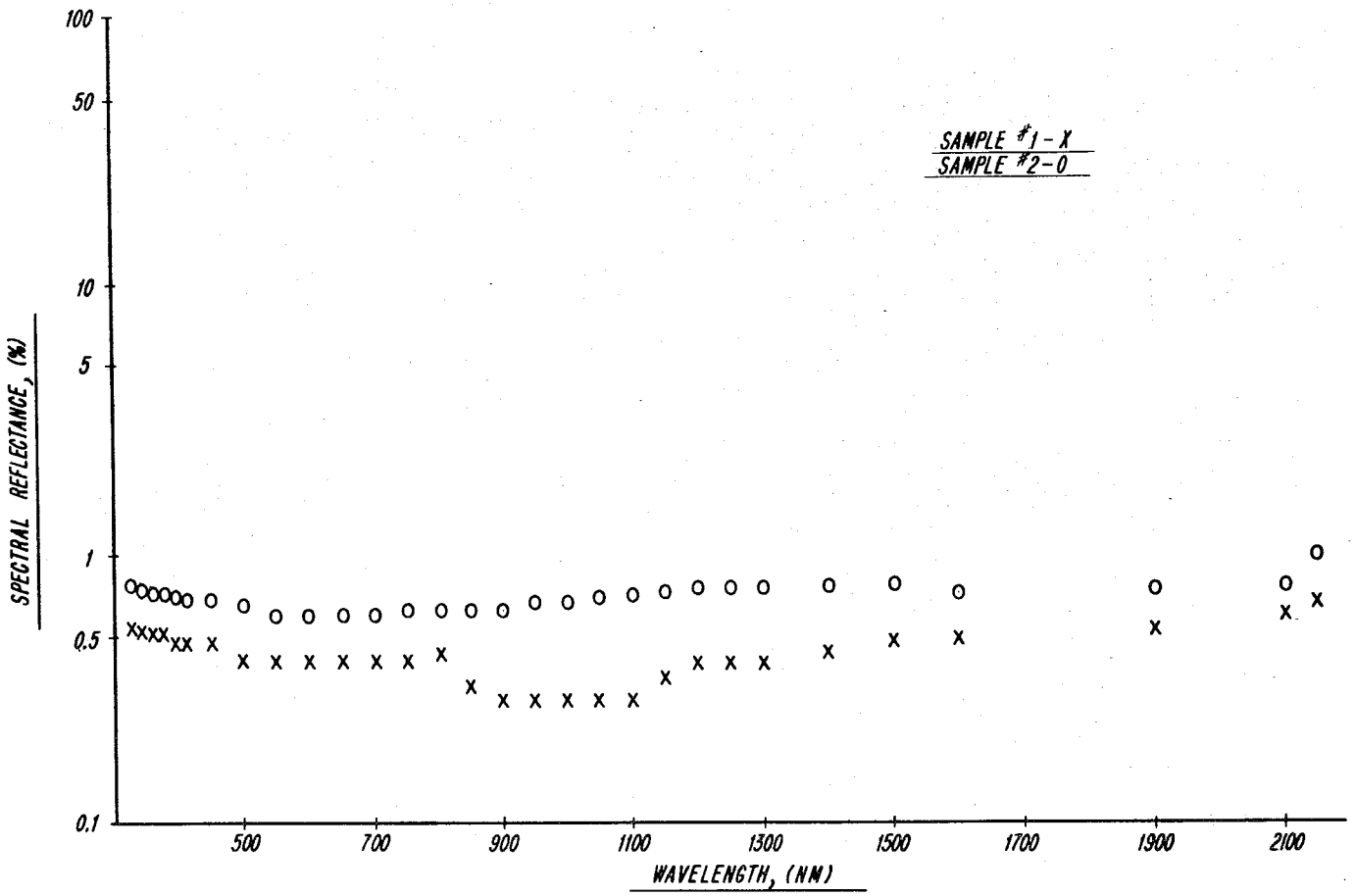
FIG. 3 is a graph of spectral reflectance versus wavelength.

Tests of two specimens show that the chemical treatment of the electroless nickel-phosphorus coating can lead to a black surface with a spectral reflectance on the order of 0.5 to 1.0% when measured at wavelengths of light from 320 to 2140 nanometers on an Edwards-type integrating sphere spectrophotometer referenced to $BaSO_4$. The results of the spectral reflectance measurements are shown in the following Table and in the accompanying FIG. 3 which shows the spectral reflectance vs. wavelengths of light for two samples of the chemically etched electroless nickel-phosphorus deposit, the curve reference being to $BaSO_4$. A test for emissivity was performed on one of the specimens with a resultant emissivity of approximately 50% when measured at room temperature. Qualitative wear resistance was performed by abrading the blackened surface with a pencil eraser which appeared to remove the black surface but in reality was only breaking off the sharp peaks of the etched surface, thus leaving more land area for light reflection. The pores were still present in the coating as revealed by scanning electron micrographs of the abraded area.

TABLE

SPECTRAL REFLECTANCE FOR BLACKENED ELECTROLESS NICKEL

| Wavelength | Spectral Reflectance* | |
|---|---|---|
| nm | Sample #1 | Sample #2 |
| 2140 | .0064 | .0100 |
| 2100 | .0060 | .0078 |
| 1900 | .0052 | .0073 |

TABLE-continued

SPECTRAL REFLECTANCE FOR BLACKENED ELECTROLESS NICKEL

| Wavelength | Spectral Reflectance* | |
|---|---|---|
| nm | Sample #1 | Sample #2 |
| 1600 | .0050 | .0072 |
| 1500 | .0047 | .0074 |
| 1400 | .0043 | .0073 |
| 1300 | .0041 | .0073 |
| 1250 | .0040 | .0074 |
| 1200 | .0040 | .0073 |
| 1150 | .0035 | .0072 |
| 1100 | .0030 | .0070 |
| 1050 | .0030 | .0068 |
| 1000 | .0030 | .0066 |
| 950 | .0030 | .0065 |
| 900 | .0030 | .0062 |
| 850 | .0033 | .0062 |
| 800 | .0044 | .0062 |
| 750 | .0040 | .0061 |
| 700 | .0040 | .0060 |
| 650 | .0040 | .0059 |
| 600 | .0040 | .0059 |
| 550 | .0040 | .0060 |
| 500 | .0042 | .0064 |
| 450 | .0047 | .0067 |
| 400 | .0048 | .0067 |
| 390 | .0049 | .0069 |
| 370 | .0052 | .0071 |
| 350 | .0052 | .0071 |
| 340 | .0054 | .0073 |
| 320 | .0055 | .0075 |

*Referenced to $BaSO_4$

What is claimed is:

1. A substrate coated with a nickel-phosphorous alloy having an ultra-black surface, the blackness being associated with a unique surface morphology consisting of a dense array of microscopic pores etched into the surface, said ultra-black surface having a spectral reflectance on the order of approximately from 0.5 to 1.0% at wavelengths of light of about from 320 to 2140 nanometers, wherein said pores are conical and have a diameter and spacing such that said surface morphology includes substantially no land area of nickel-phosphorous alloy between said conical pores.

2. The coated substrate of claim 1, wherein the average maximum diameter, depth, and spacing of the pores range from a fraction of a micrometer to several micrometers.

* * * * *